US009874364B2

(12) United States Patent
Bujak, Jr. et al.

(10) Patent No.: US 9,874,364 B2
(45) Date of Patent: Jan. 23, 2018

(54) ECONOMIZER DAMPER FAULT DETECTION

(71) Applicant: Carrier Corporation, Farmington, CT (US)

(72) Inventors: Walter E. Bujak, Jr., Suffield, CT (US); Michael R. Cote, Terryville, CT (US)

(73) Assignee: CARRIER CORPORATION, Farmington, CT (US)

( * ) Notice: Subject to any disclaimer, the term of this patent is extended or adjusted under 35 U.S.C. 154(b) by 329 days.

(21) Appl. No.: 14/695,430

(22) Filed: Apr. 24, 2015

(65) Prior Publication Data

US 2015/0309120 A1 Oct. 29, 2015

Related U.S. Application Data

(60) Provisional application No. 61/985,132, filed on Apr. 28, 2014.

(51) Int. Cl.

| | |
|---|---|
| ***G01R 31/34*** | (2006.01) |
| ***F24F 11/00*** | (2006.01) |
| ***F24F 13/14*** | (2006.01) |

(52) U.S. Cl.

CPC ..... *F24F 11/0001* (2013.01); *F24F 11/001* (2013.01); *F24F 13/14* (2013.01); *F24F 2011/0052* (2013.01); *F24F 2011/0056* (2013.01)

(58) Field of Classification Search

CPC ..... F24F 11/0001; F24F 11/001; F24F 13/14

See application file for complete search history.

(56) References Cited

U.S. PATENT DOCUMENTS

| | | | | |
|---|---|---|---|---|
| 5,446,677 | A | 8/1995 | Jensen et al. | |
| 5,705,734 | A | 1/1998 | Ahmed | |
| 6,223,544 | B1 | 5/2001 | Seem | |
| 6,981,383 | B2 | 1/2006 | Shah et al. | |
| 7,036,559 | B2 | 5/2006 | Stanimirovic | |
| 7,308,384 | B2 | 12/2007 | Shah et al. | |
| 8,109,101 | B2 | 2/2012 | Taras et al. | |
| 8,588,983 | B2 | 11/2013 | Grabinger et al. | |
| 8,635,182 | B2 | 1/2014 | Mackay | |
| 2009/0266903 | A1 * | 10/2009 | Fitzgerald | F24F 13/105 236/49.3 |
| 2012/0245968 | A1 | 9/2012 | Beaulieu et al. | |

(Continued)

FOREIGN PATENT DOCUMENTS

JP 2011043250 A * 3/2011

*Primary Examiner* — Daniel Miller

(74) *Attorney, Agent, or Firm* — Cantor Colburn LLP

(57) ABSTRACT

A method of evaluating damper operation for a heating, ventilation and air conditioning (HVAC) system includes moving a plurality of dampers of the HVAC system collectively to a baseline damper position. The plurality of dampers is positioned at a flowpath including a fan driven by a motor. The fan is operating by switching the motor on and a baseline output level at the motor is measured. A first damper of the plurality of dampers is commanded to move from the baseline damper position to a first damper position and a first output level at the motor is measured. The first output level is compared to the baseline output level. A difference is indicative of successful movement of the first damper from the baseline damper position to the first damper position.

18 Claims, 4 Drawing Sheets

(56) References Cited

U.S. PATENT DOCUMENTS

| | | | |
|---|---|---|---|
| 2013/0161403 | A1 | 6/2013 | Douglas et al. |
| 2013/0180700 | A1 | 7/2013 | Aycock |
| 2013/0324027 | A1 | 12/2013 | Davis |
| 2014/0067135 | A1 | 3/2014 | Lehnert et al. |

* cited by examiner

ECONOMIZER DAMPER FAULT DETECTION

CROSS-REFERENCE TO RELATED APPLICATIONS

This application claims the benefit of U.S. provisional patent application Ser. No. 61/985,132, filed Apr. 28, 2014, the entire contents of which are incorporated herein by reference.

BACKGROUND

The subject matter disclosed herein relates to heating, ventilation and air conditioning (HVAC) systems. More specifically, the subject matter disclosed herein relates to HVAC systems equipped with an economizer or air handling unit utilizing outdoor air.

A typical economizer or air handling unit includes one or more dampers to control the flow of outdoor air and return air through the economizer. For efficient operation of the HVAC system, it is necessary for all of the dampers to operate properly. New regulatory requirements now necessitate that any HVAC equipment with an economizer or outdoor air damper to accurately detect when the damper(s) of an economizer or mixing box of an air handling unit become stuck or mechanically disconnected from an actuator.

In a typical application, a single actuator modulates a return air damper that is mechanically linked to an outdoor air damper. The outdoor and return air dampers are positioned in such a way that they are 180 degrees out of phase and move in unison. When the outdoor air damper is closed the return damper is fully open, and, as one damper opens the other closes. Detecting the fault conditions can be accomplished by monitoring the Supply Air Temperature (SAT) in relation to Outdoor Air Temperature (OAT) and Return Air Temperature (RAT) as the economizer modulates position, and the ratio of outdoor air to return air changes. As the economizer modulates open, the ratio of outdoor air to return air will increase, and the additional outdoor air will cause SAT to trend toward the Outdoor Air temperature. As the economizer is closed, the ratio of outdoor air to return air will decrease, and the increased return air will cause SAT to trend toward RAT. If the actuator becomes stuck or mechanically disconnected from the damper assembly, modulating the actuator will not result in a change of damper position and the ratio of outdoor air to return air will stay at the same constant ratio, and no trend in SAT will be observed. If SAT does not trend as expected when the actuator position is changed, it can be concluded that the damper is not moving as expected. The above only works, however, when the difference between OAT and RAT is large. For larger units, a single actuator may not provide enough torque to modulate both the outdoor and return dampers through a linkage assembly. In this case, it is required to attach a separate actuator to each of the outdoor and return dampers. If one actuator should become stuck or mechanically disconnected from its corresponding damper, the other actuator will continue to properly modulate its damper. With one actuator/damper pair functioning properly, the ratio of outdoor air to return air will change. The outdoor/return air ratio change will result in an SAT trend, which can lead to the false conclusion that the actuators and dampers are functioning properly.

BRIEF SUMMARY

In one embodiment, a method of evaluating damper operation for an HVAC system includes moving a plurality of dampers of the HVAC system collectively to a baseline damper position. The plurality of dampers is positioned at a flowpath including a fan driven by a motor. The fan is operating by switching the motor on and a baseline output level at the motor is measured. A first damper of the plurality of dampers is commanded to move from the baseline damper position to a first damper position and a first output level at the motor is measured. The first output level is compared to the baseline output level. A difference is indicative of successful movement of the first damper from the baseline damper position to the first damper position.

Additionally or alternatively, in this or other embodiments an alert is generated if a difference between the first output level and the baseline output level does not exceed a threshold value.

Additionally or alternatively, in this or other embodiments the baseline position of the plurality of dampers is a closed position, restricting airflow into the flowpath.

Additionally or alternatively, in this or other embodiments the first damper position is an open position, allowing airflow into the flowpath and increasing flow across the fan.

Additionally or alternatively, in this or other embodiments the first output level is greater than the baseline output level.

Additionally or alternatively, in this or other embodiments the first power output level and the baseline power output level are measured in one or more of power, electrical current or torque.

Additionally or alternatively, in this or other embodiments the first damper is commanded to return to the baseline damper position, and a second damper of the plurality of dampers is commanded to move from the baseline damper position to a second damper position. A second output level at the motor is measured, and the second output level is compared to the baseline output level. A difference is indicative of successful movement of the second damper from the baseline damper position to the second damper position.

Additionally or alternatively, in this or other embodiments the second damper position is an opened position, increasing flow into the flowpath and across the fan.

Additionally or alternatively, in this or other embodiments the second output level is greater than the baseline output level.

Additionally or alternatively, in this or other embodiments the baseline position is an opened position, allowing flow into the flowpath and across the fan. The first damper position is a closed position, reducing flow into the flowpath and across the fan. A decrease in the first output level relative to the baseline output level is indicative of successful movement of the first damper from the baseline damper position to the first damper position.

Additionally or alternatively, in this or other embodiments a damper of the plurality of dampers comprises a plurality of louvers.

In another embodiment, a controller for a heating, ventilation and air conditioning (HVAC) system is configured to command a plurality of dampers of the HVAC system operably connected to the controller collectively to a baseline damper position. The dampers are positioned at a flowpath including a fan driven by a motor. The controller operates the fan by switching the motor on. The controller measures a baseline output level at the motor and commands a first damper of the plurality of dampers to move from the baseline damper position to a first damper position. The controller measures a first output level at the motor and compares the first output level to the baseline output level.

A difference is indicative of successful movement of the first damper from the baseline damper position to the first damper position.

Additionally or alternatively, in this or other embodiments the first damper is an outside air damper movable across an outside air opening to regulate a flow of outside air through the outside air opening.

Additionally or alternatively, in this or other embodiments a second damper of the plurality of dampers is a return air damper movable between an exhaust air opening and a return air opening to selectively direct a return airflow into the mixed air chamber via the return air opening and/or through the exhaust air opening.

Additionally or alternatively, in this or other embodiments the controller is operably connected to an outside air damper actuator operably connected to the outside air damper to drive movement thereof and a return air damper actuator operably connected to the return air damper to drive movement thereof.

Additionally or alternatively, in this or other embodiments the baseline position is a closed position restricting allowance of the return airflow and the flow of outside air into the mixed air chamber.

Additionally or alternatively, in this or other embodiments the first power output level and the baseline power output level are measured in one or more of power, electrical current or torque.

Additionally or alternatively, in this or other embodiments a damper of the plurality of dampers comprises a plurality of louvers.

These and other advantages and features will become more apparent from the following description taken in conjunction with the drawings.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

Figure 1:
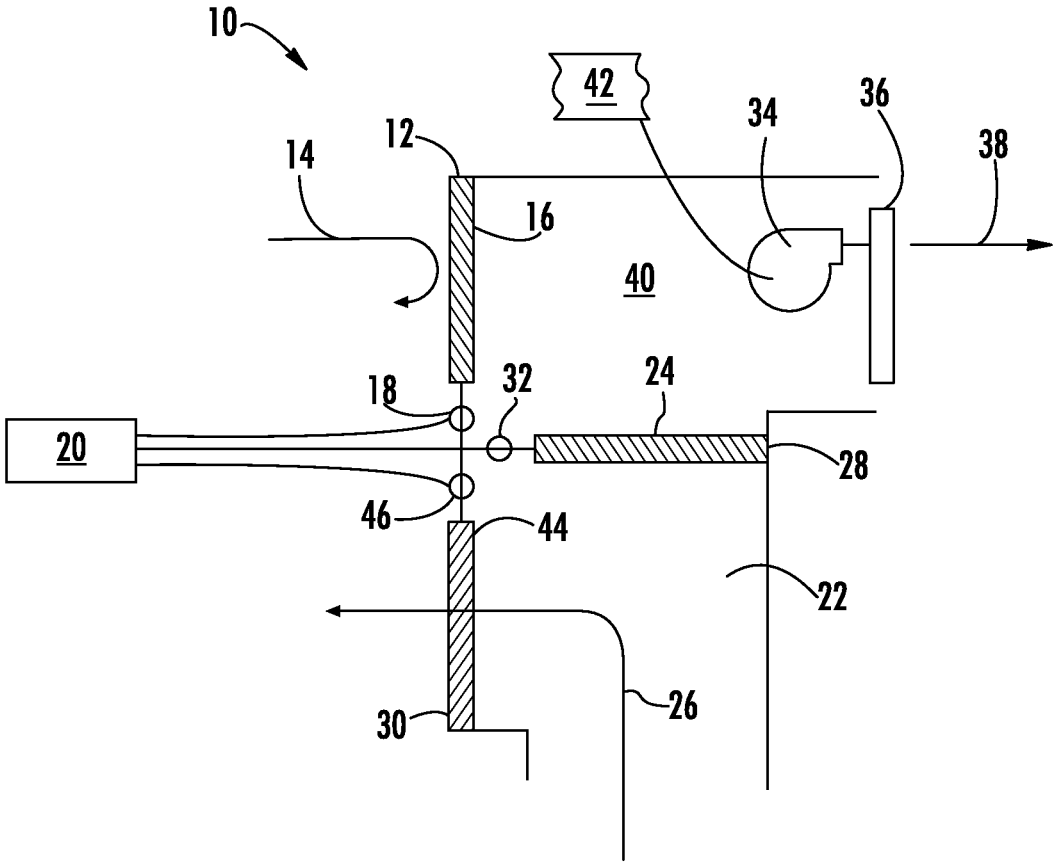
FIG. 1 is a plan view of an embodiment of a damper arrangement of an HVAC system.

Shown in FIG. 1 is a schematic of an embodiment of a damper arrangement for an economizer 10 of a heating, ventilation and air conditioning (HVAC) system. The arrangement includes an outside air inlet 12, which allows a flow of outside air 14 to be directed into the system. An outside air damper 16 is located at the outside air inlet 12 and is movable across the outside air inlet 12 to regulate the flow of outside air 14. The outside air damper 16 is operated by an outside air damper actuator 18 connected thereto, and controlled via a system controller 20 that directs operation of the outside air damper 16 based on HVAC system needs. The arrangement further includes a return air duct 22 having a return air damper 24 positioned therein. The return air damper 24 is movable across the return air duct 22 to direct a return airflow 26 through a return air opening 28 into the economizer 10 and/or through an exhaust air opening 30 to remove the return airflow 26 from the system. The return air damper 24 is operated by a return air damper actuator 32 connected to the system controller 20. A motor 34, such as an electric motor, drives a fan 36 to direct the return airflow 26 and/or the flow of outside air 14 into the economizer 10 as supply airflow 38. An exhaust air damper 44 driven by exhaust air damper actuator 46 is utilized to selectively direct return airflow 26 out of the exhaust air opening 30 or through the return air opening 28. While the arrangement described herein includes three dampers, it is to be appreciated that systems having other quantities of dampers, for example, 2 or 4 dampers will benefit from the present disclosure. Further, each damper may be a single panel extending across the respective opening, or alternatively may comprise multiple panels, i.e. a louver arrangement extending across the opening.

For the HVAC system and economizer 10 to operate properly, the dampers 16, 24, 44 must properly modulate when commanded to do so by the controller 20. It is desired to accurately determine that the proper modulation, movement of the dampers 16, 24, 44 as expected, is occurring. The present disclosure utilizes fan 36 characteristics and motor 34 output level measurements to determine whether the dampers 16, 24, 44 are properly modulating. To do this, each actuator 18, 32, 46 is separately commanded to modulate dampers 16, 24, 44 and select fan 36 and motor 34 characteristics are monitored for changes. If the changes are as expected, the dampers 16, 24, 44 are modulating correctly.

Figure 2:
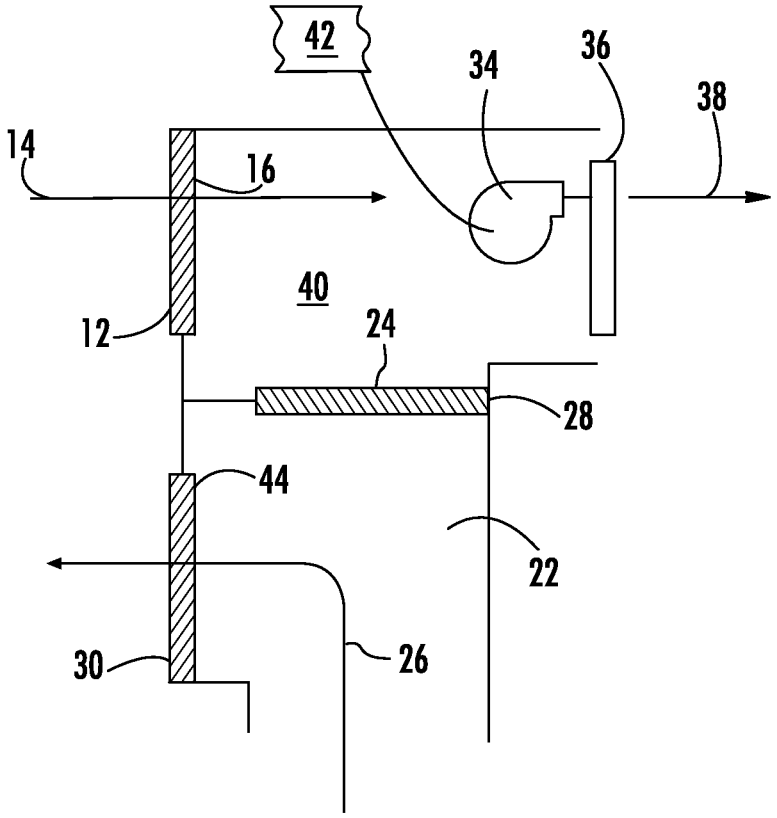
FIG. 2 is another plan view of an embodiment of a damper arrangement of an HVAC system.
Figure 3:
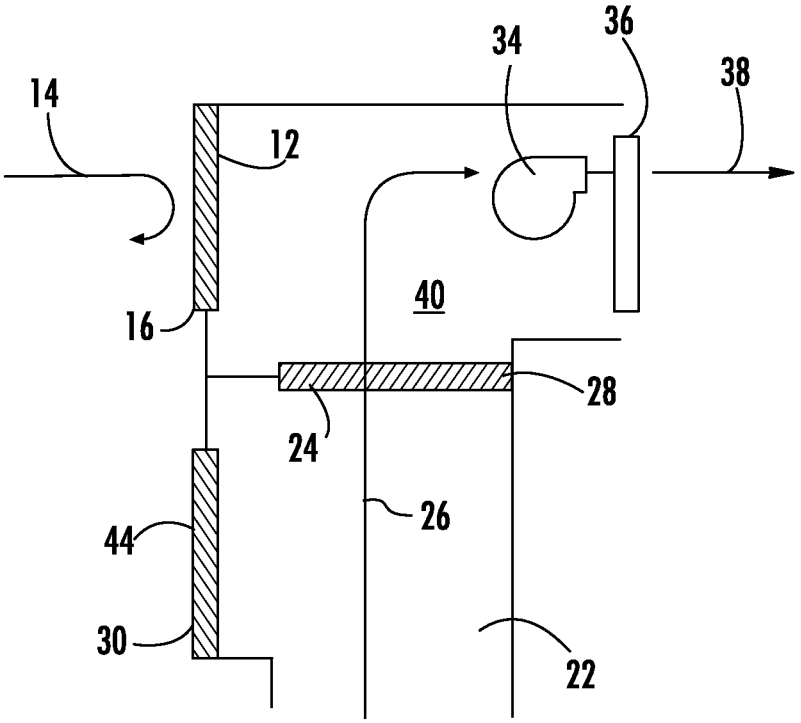
FIG. 3 is yet another plan view of an embodiment of a damper arrangement of an HVAC system.

One method for evaluating the damper 16, 24, 44 modulation is illustrated in FIGS. 1-3 and described below. Referring to FIG. 1, dampers 16 and 24 are both commanded to the closed position by the controller 20. In this position, the damper 16 blocks the flow of outside air 14 from entering the system and the return air damper 24 is oriented to direct the return airflow 26 out through the exhaust air opening 30. Thus, no airflow is entering a mixed air chamber 40, where the motor 34 and fan 36 are located. The motor 34 is turned on, so the fan is operated, and an output level measurement, such as power (watts), current (amps) or torque, at the motor 34 is taken via a power meter 42 or other such device. This measurement will serve as a baseline output level measurement, and will be the lowest output level measurement, as in this configuration with both dampers 16, 24 commanded to the closed positions, the amount of airflow is the least.

Referring now to FIG. 2, the outside air damper 16 is commanded to the open position, to allow the flow of outside air 14 into the economizer 10. The motor 34 output level is measured again. If the outside air damper 16 moves as commanded, the airflow through the mixed air chamber 40 will increase, resulting in an increase of output level at the motor 34. Next, referring to FIG. 3, the outside air damper 16 is commanded to the closed position, and the return air damper 24 is commanded to the opened position and the exhaust air damper 44 is commanded to a closed position. In this configuration, the flow of outside air 14 is stopped from entering the economizer 10, while the exhaust air damper 44 blocks the exhaust air opening 30. The return airflow 26 is directed through the return air opening 28 into the economizer 10. Motor 34 output level is then measured once again, and if the return air damper 24 is functioning properly, a rise in output level over the baseline output level measurement is expected, because of the increase in airflow across the fan 36. This process is then repeated for any additional dampers and actuators to determine if the dampers are functioning properly. If the output level measurement increases relative to the baseline output level measurement, it may be concluded that the tested damper is functioning properly. If the output level measurement is the same as the baseline output level measurement, the tested damper is not functioning as expected. For example, the actuator may have failed, the actuator may have become mechanically disconnected from the damper, or the damper may be stuck. In such instances where one or more dampers are not operating as expected, an alarm or alert may be generated. It is to be appreciated that while in this embodiment the outside air damper 16 is tested then the return air damper 24 is tested, the testing of individual dampers may be done in any order. For example, in some embodiments, the return air damper 24 is tested prior to the testing of the outside air damper 16.

Figure 4:
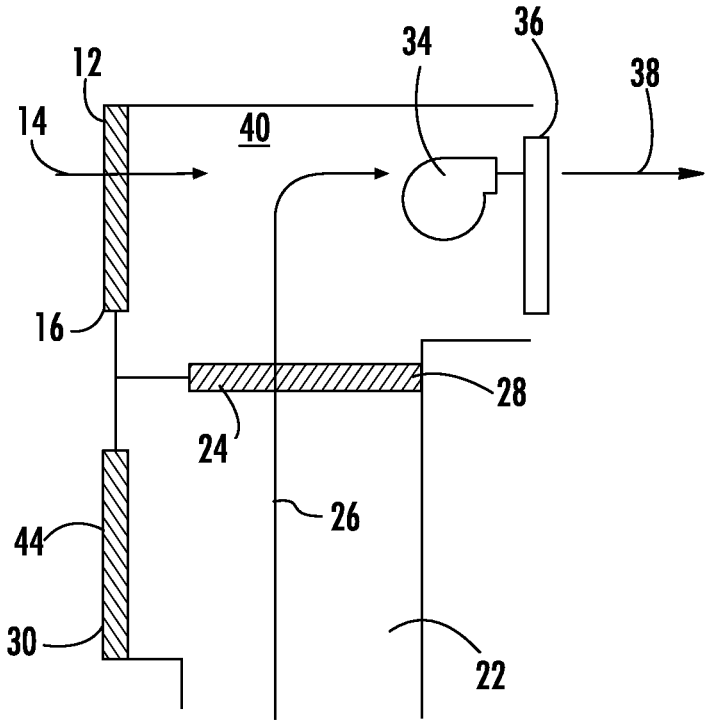
FIG. 4 is still another plan view of an embodiment of a damper arrangement of an HVAC system.

It is to be appreciated that, while in this embodiment, the baseline output level measurement is taken with dampers 16, 24 closed, and individual damper condition is assessed by commanding the opening of individual dampers, in other embodiments, the process may be substantially reversed. For example, and referring to FIG. 4, the baseline output level measurement may be taken with any one of the dampers 16 or 24 commanded to their open positions and the exhaust air damper 44 closed. In the open position, outside air damper 16 admits the flow of outside air 14 into the mixed air chamber 40, and the exhaust air damper 44 closes the exhaust air opening 30. This configuration directs the maximum outside airflow cross the fan 36, thus the baseline output level measurement at the motor 34 in this instance would be expected to be highest. Individual damper 16 is then evaluated by commanding it to the closed position, and measuring the motor 34 output level again. If the individual damper 16 is functioning properly, the measured motor 34 output level is expected to be lower than the baseline output level measurement. The process is then again repeated for return air damper 24 whereby the outside air damper 16 is commanded to the closed position and the return air damper 24 is commanded to the fully open position. Again a baseline output level measurement, baseline 2, at the motor 34 in this instance would be expected to be highest. The individual damper 24 is then evaluated by commanding it to the closed position, and measuring the motor 34 output level again. If the individual damper 24 is functioning properly, the measured motor 34 output level is expected to be lower than the baseline 2 output level measurement. This process may be repeated for each damper in the system.

Utilizing motor 34 output level measurements to determine damper 16, 24 conditions allows for accurate determination of damper 16, 24 functionality for economizers 10 with multiple dampers 16, 24 and actuators 18, 32. This method does not require a difference between outside air temperature (OAT) and room air temperature (RAT) to make an accurate determination.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A method of evaluating damper operation for a heating, ventilation and air conditioning (HVAC) system comprising:

moving a plurality of dampers of the HVAC system collectively to a baseline damper position, the dampers positioned at a flowpath including a fan driven by a motor;

operating the fan by switching the motor on;

measuring a baseline output level at the motor;

commanding a first damper of the plurality of dampers to move from the baseline damper position to a first damper position;

measuring a first output level at the motor; and comparing the first output level to the baseline output level, a difference indicative of successful movement of the first damper from the baseline damper position to the first damper position; wherein the first damper of the plurality of dampers is one of an outside air damper, a return air damper or an exhaust air damper of the HVAC system.

2. The method of claim 1, further comprising generating an alert if a difference between the first output level and the baseline output level does not exceed a threshold value.

3. The method of claim 1, wherein the baseline position of the plurality of dampers is a closed position, restricting airflow into the flowpath.

4. The method of claim 3, wherein the first damper position is an open position, allowing airflow into the flowpath and increasing flow across the fan.

5. The method of claim 4, wherein the first output level is greater than the baseline output level.

6. The method of claim 1, wherein the first power output level and the baseline power output level are measured in one or more of power, electrical current or torque.

7. The method of claim 1, further comprising:

commanding the first damper to return to the baseline damper position;

commanding a second damper of the plurality of dampers to move from the baseline damper position to a second damper position;

measuring a second output level at the motor; and comparing the second output level to the baseline output level, a difference indicative of successful movement of the second damper from the baseline damper position to the second damper position.

8. The method of claim 7, wherein the second damper position is an opened position, increasing flow into the flowpath and across the fan.

9. The method of claim 8, wherein the second output level is greater than the baseline output level.

10. The method of claim 1, wherein:

the baseline position is an opened position, allowing flow into the flowpath and across the fan;

the first damper position is a closed position, reducing flow into the flowpath and across the fan; and a decrease in the first output level relative to the baseline output level is indicative of successful movement of the first damper from the baseline damper position to the first damper position.

11. The method of claim 1, wherein a damper of the plurality of dampers comprises a plurality of louvers.

12. A controller for a heating, ventilation and air conditioning (HVAC) system, the controller configured to:

command a plurality of dampers of the HVAC system operably connected to the controller collectively to a baseline damper position, the dampers positioned at a flowpath including a fan driven by a motor;

operate the fan by switching the motor on;

measure a baseline output level at the motor;

command a first damper of the plurality of dampers to move from the baseline damper position to a first damper position;

measure a first output level at the motor; and compare the first output level to the baseline output level, a difference indicative of successful movement of the first damper from the baseline damper position to the first damper position; wherein the first damper of the plurality of dampers is one of an outside air damper, a return air damper or an exhaust air damper of the HVAC system.

13. The controller of claim 12, wherein the first damper is an outside air damper movable across an outside air opening to regulate a flow of outside air through the outside air opening.

14. The controller of claim 12, wherein a second damper of the plurality of dampers is a return air damper movable between an exhaust air opening and a return air opening to selectively direct a return airflow into the mixed air chamber via the return air opening and/or through the exhaust air opening.

15. The controller of claim 12, wherein the controller is operably connected to:

an outside air damper actuator operably connected to the outside air damper to drive movement thereof; and a return air damper actuator operably connected to the return air damper to drive movement thereof.

16. The controller of claim 12, wherein the baseline position is a closed position restricting allowance of the return airflow and the flow of outside air into the mixed air chamber.

17. The controller of claim 12, wherein the first power output level and the baseline power output level are measured in one or more of power, electrical current or torque.

18. The method of claim 12, wherein a damper of the plurality of dampers comprises a plurality of louvers.

* * * * *